US008505915B2

(12) United States Patent
Tseng

(10) Patent No.: US 8,505,915 B2
(45) Date of Patent: Aug. 13, 2013

(54) CARD GAME MACHINE

(76) Inventor: Tzu-Hsiang Tseng, Taichung (TW)

( * ) Notice: Subject to any disclaimer, the term of this patent is extended or adjusted under 35 U.S.C. 154(b) by 114 days.

(21) Appl. No.: 13/160,548

(22) Filed: Jun. 15, 2011

(65) Prior Publication Data

US 2012/0319351 A1 Dec. 20, 2012

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS 7,789,311 B2 * 9/2010 Jones et al. ..... 235/487
7,804,982 B2 * 9/2010 Howard et al. ..... 382/115
7,824,029 B2 * 11/2010 Jones et al. ..... 347/101
8,089,458 B2 * 1/2012 Barney et al. ..... 345/158
8,164,567 B1 * 4/2012 Barney et al. ..... 345/158
8,169,406 B2 * 5/2012 Barney et al. ..... 345/158
8,184,097 B1 * 5/2012 Barney et al. ..... 345/158

* cited by examiner

*Primary Examiner* — Kurt Fernstrom
*Assistant Examiner* — Dolores Collins
(74) *Attorney, Agent, or Firm* — Muncy, Geissler, Olds & Lowe, PLLC

(57) ABSTRACT

A card game machine includes a machine base, a track unit arranged on the machine base, a displacement motor mounted on the machine base, two card-recovery slots, a video recognition device adapted for recognizing the types and spots of each individual playing card of a set of playing cards being arranged on the machine base, a slide coupled to and movable along the track unit, a transmission belt coupled between the slide and the displacement motor for enabling the slide to be moved by the displacement motor along the track unit, and a first pickup unit and a second pickup unit carried on the slide alternatively controllable to run a playing card pickup step, a playing card recognition step, a playing card exhibition step and a playing card discarding step.

1 Claim, 6 Drawing Sheets

| First pickup unit | Second pickup unit |
|---|---|
| Playing card pickup | |
| Playing card recognition | |
| Playing card exhibition | Playing card pickup |
| Playing card recovery | Playing card recognition |
| Playing card pickup | Playing card exhibition |
| Playing card recognition | Playing card recovery |
| Playing card exhibition | Playing card pickup |
| Playing card recovery | Playing card recognition |
| | Playing card exhibition |
| | Playing card recovery |
| | Playing card pickup |
| | Playing card recognition |

FIG. 11

CARD GAME MACHINE

BACKGROUND OF THE INVENTION

1. Field of the Invention

The present invention relates to card game technology and more particularly, to a playing card machine, which can simulate the operation of a dealer to deal playing cards rapidly, avoiding cheating in playing the game.

2. Description of the Related Art

Conventional card game machines commonly use a mechanical arm to pick deal the playing cards, i.e., to pick up the playing cars, to recognize the playing cards, to exhibit the playing cards and to recover the playing cards. A mechanical arm for this purpose has a complicated structure and is expensive to manufacture. Further, it takes much time to complete one playing card dealing cycle.

SUMMARY OF THE INVENTION

The present invention has been accomplished under the circumstances in view. It is one object of the present invention to provide a card game machine, which can simulate the operation of a dealer to deal playing cards rapidly, avoiding cheating in playing the game.

To achieve this and other objects of the present invention, a card game machine comprises: a machine base, a track unit arranged on the machine base, a displacement motor mounted on the machine base, two card-recovery slots, a video recognition device adapted for recognizing the types and spots of each individual playing card of a set of playing cards being arranged on the machine base, a slide coupled to and movable along the track unit, a transmission belt coupled between the slide and the displacement motor for enabling the slide to be moved by the displacement motor along the track unit, and a first pickup unit and a second pickup unit carried on the slide alternatively controllable to run a playing card pickup step, a playing card recognition step, a playing card exhibition step and a playing card discarding step, the first pickup unit and the second pickup unit each comprising a reversible step motor, a swivel arm coupled to the reversible step motor and movable by the reversible step motor within a predetermined angle, an air cylinder coupled to the swivel arm, a vacuum mount mounted on a reciprocating rod of the air cylinder and controllable to pick up one playing card from the set of playing cards by vacuum suction.

BRIEF DESCRIPTION OF THE DRAWINGS

FIG. 11 is a schematic top view of the present invention, illustrating the relative operation flows of the first pickup unit and the second pickup unit.

DETAILED DESCRIPTION OF THE PREFERRED EMBODIMENT

Figure 1:
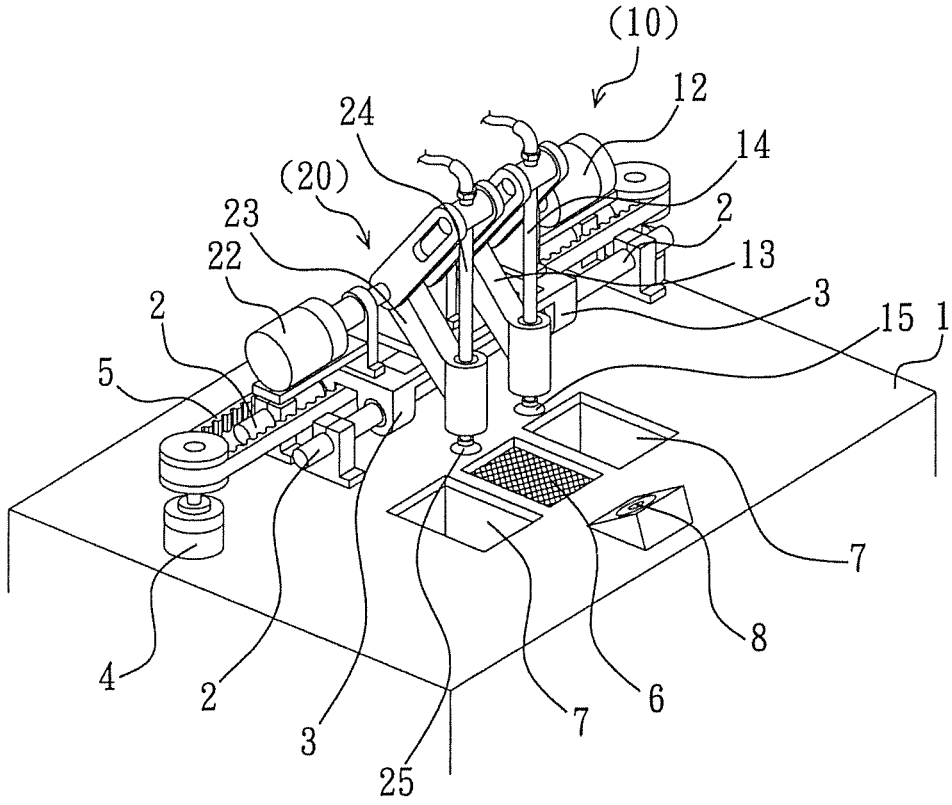
FIG. 1 is a perspective partial view of a card game machine in accordance with the present invention.
Figure 2:
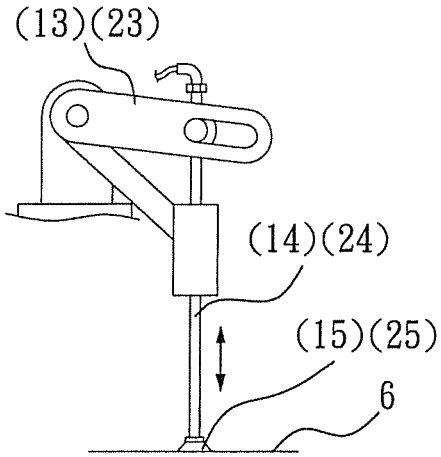
FIG. 2 is a schematic side view of a part of the present invention, illustrating the operation of the playing card pickup step.
Figure 3:
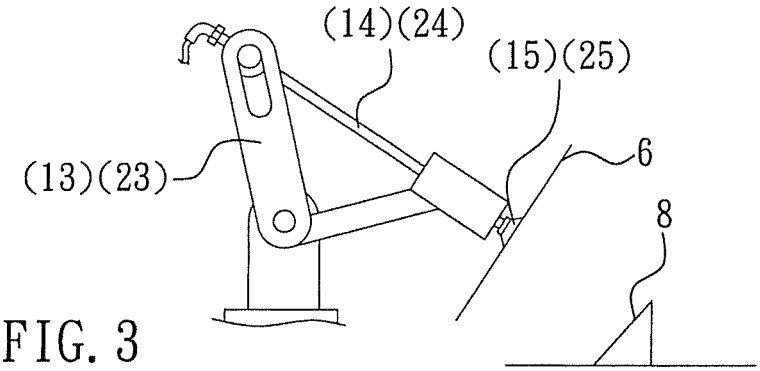
FIG. 3 is a schematic side view of a part of the present invention, illustrating the operation of the playing card recognition step.
Figure 4:
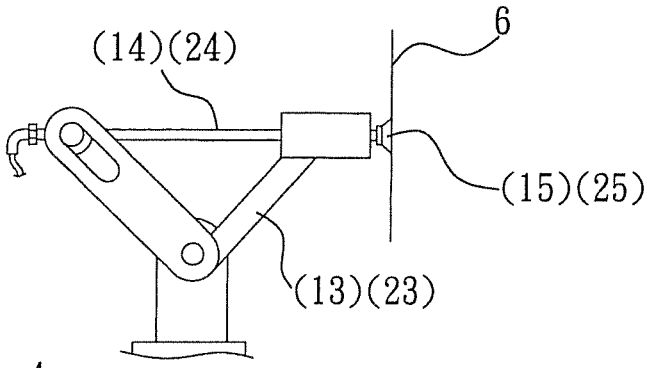
FIG. 4 is a schematic side view of a part of the present invention, illustrating the operation of the playing card exhibition step.
Figure 5:
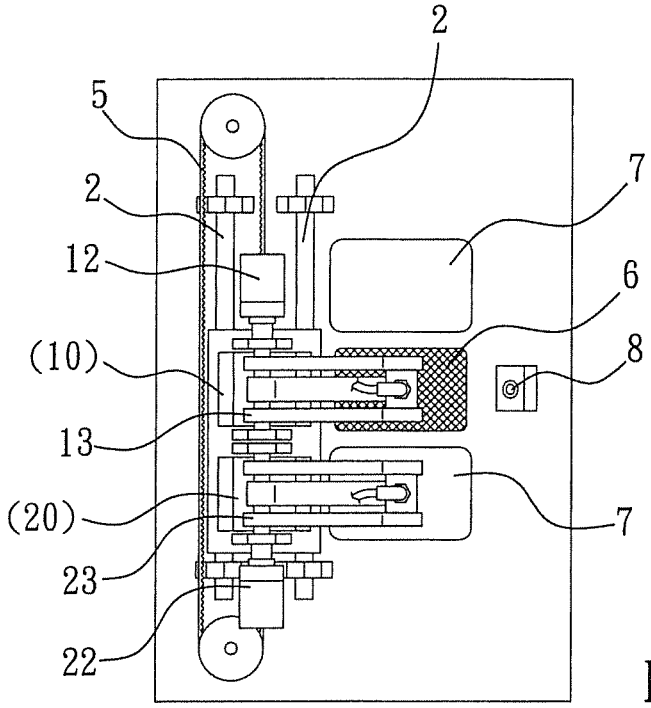
FIG. 5 is a schematic top view of the present invention, illustrating the operation of the playing card pickup step of the first pickup unit.
Figure 6:
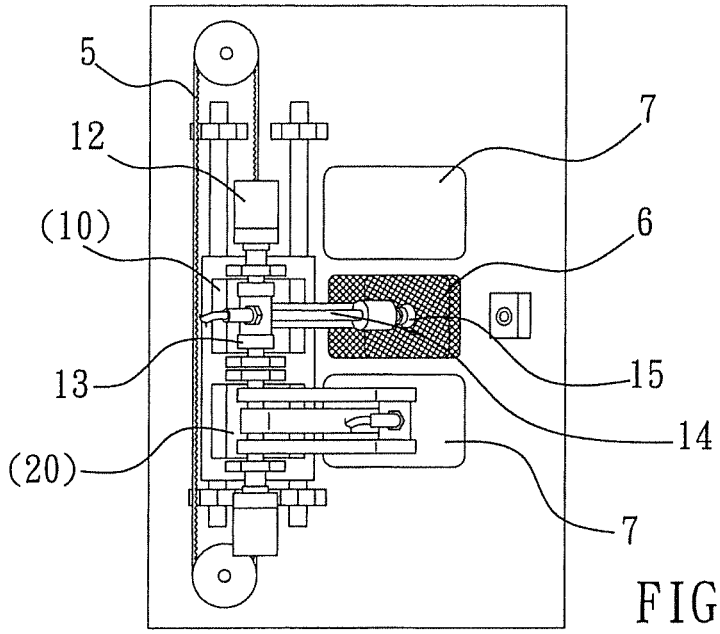
FIG. 6 is a schematic top view of the present invention, illustrating the operation of the playing card recognition step of the first pickup unit.

Referring to FIGS. 1~6, a card game machine in accordance with the present invention is shown comprising a machine base 1 having arranged thereon a track unit 2, a displacement motor 4, two card-recovery slots 7, a video recognition device 8, a slide 3 coupled to and movable along the track unit 2, a transmission belt 5 coupled between the slide 3 and the displacement motor 4, and a first pickup unit 10 and a second pickup unit 20 carried on the slide 3. The first pickup unit 10 and the second pickup unit 20 each comprises a reversible step motor 12;22, a swivel arm 13;23 coupled to the output shaft of the reversible step motor 12;22 and movable by the reversible step motor 12;22 within a predetermined angle, an air cylinder 14;24 coupled to the swivel arm 13;23, a vacuum mount 15;25 mounted on the reciprocating rod of the air cylinder 14;24 and controllable to pick up a playing card 6 by vacuum suction.

Figure 7:
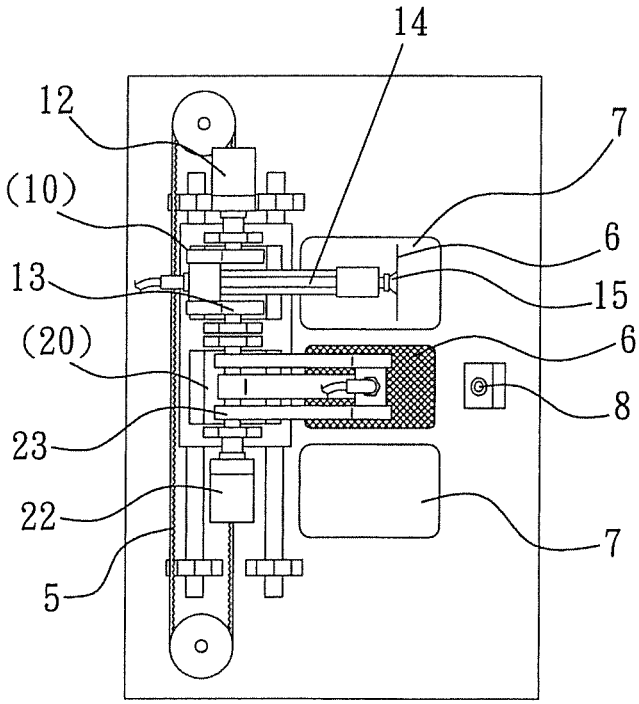
FIG. 7 is a schematic top view of the present invention, illustrating the first pickup unit in the playing card exhibition step and the second pickup unit in the playing card pickup step.
Figure 8:
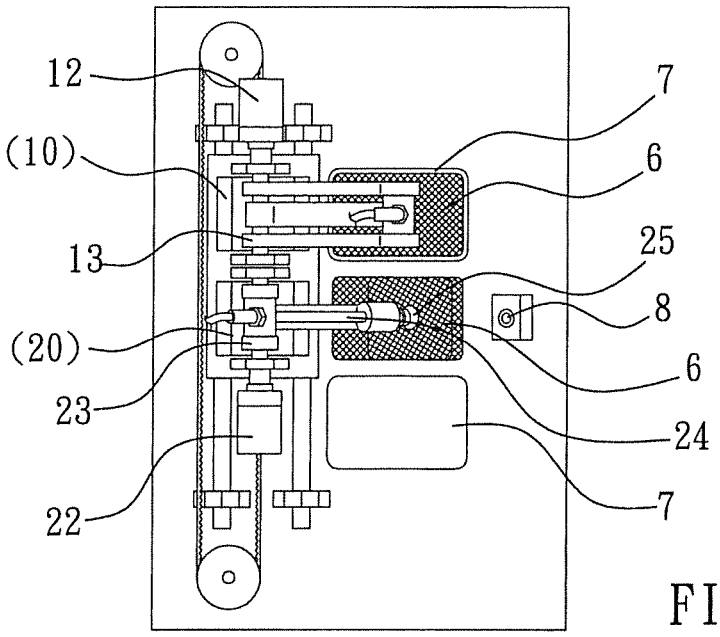
FIG. 8 is a schematic top view of the present invention, illustrating the first pickup unit in the playing card recognition step and the second pickup unit in the playing card exhibition step.
Figure 9:
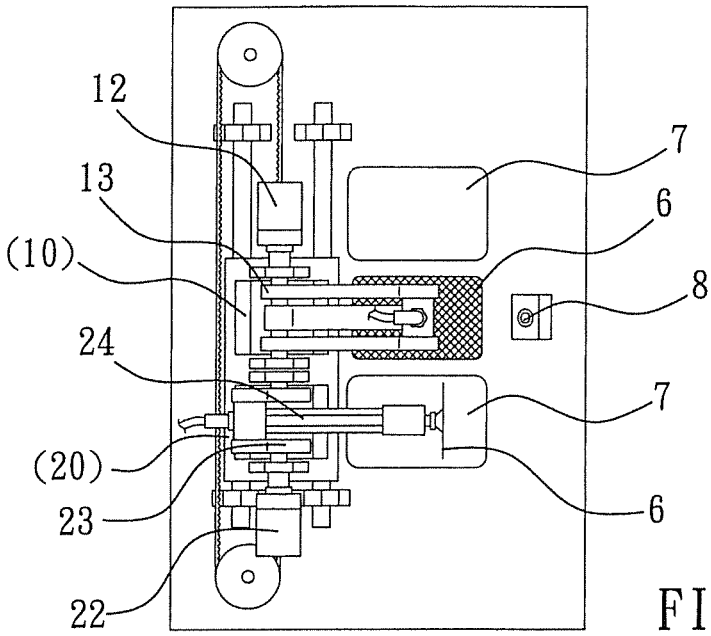
FIG. 9 is a schematic top view of the present invention, illustrating the second pickup unit in the playing card exhibition step and the first pickup unit in the playing card pickup step.
Figure 10:
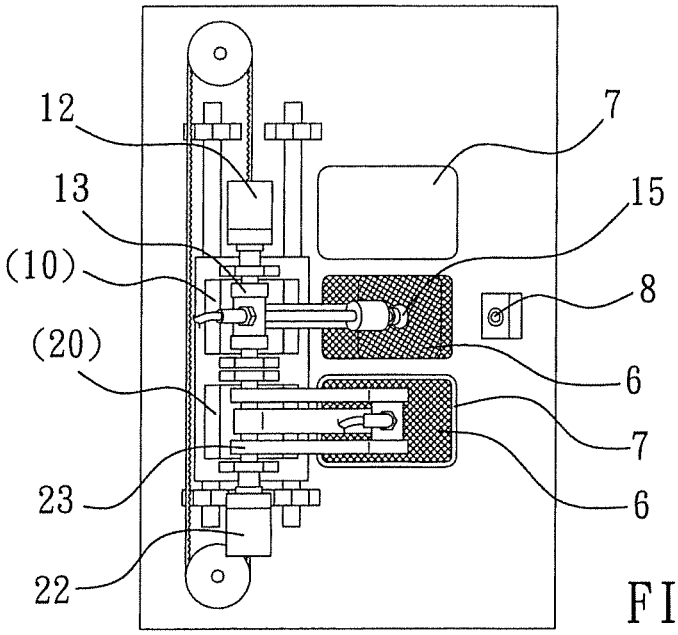
FIG. 10 is a schematic top view of the present invention, illustrating the second pickup unit in the playing card recovery step and the first pickup unit in the playing card recognition step.

Referring to FIG. 11, the operation and effects of the card game machine are outlined hereinafter. At the initial stage, as shown in FIGS. 2 and 5 and FIGS. 3 and 6, the displacement motor 4 is moved to the position where the first pickup unit 10 is aimed at the playing cards 6 that are stacked up on the machine base 1 at a predetermined dispensing zone, and then the reversible step motor 12 is rotated to turn the swivel arm 13 to a predetermined angle, and then the air cylinder 14 is controlled to lower the vacuum mount 15, enabling the vacuum mount 15 to pick up one playing card 6 (see FIGS. 2 and 5). Thereafter, the swivel arm 13 is turned to such an angle where the vacuum mount 15 holds the playing card 6 to face toward the video recognition device 8 (see FIGS. 3 and 6), enabling the video recognition device 8 to recognize the kind and spots of the playing card 6. Thereafter, as shown in FIG. 7, the displacement motor 4 is moved to the position where the second pickup unit 20 is aimed at the prepared set of playing cards 6, and then the reversible step motor 22 is rotated to turn the swivel arm 23 to a predetermined angle, and then the air cylinder 24 is controlled to lower the vacuum mount 25, enabling the vacuum mount 25 to pick up another playing card 6, and at the same time, the first pickup unit 10 is controlled to exhibit the respective playing card 6. Thereafter, as shown in FIG. 8, the first pickup unit 10 is controlled to discard the respective playing card 6 onto one card-recovery slot 7, and the second pickup unit 20 is controlled to let the respective playing card 6 face toward the video recognition device 8 for recognition. Thereafter, as shown in FIG. 9, the displacement motor 4 is moved to carry the slide 3 to the position where the first pickup unit 10 is aimed at the prepared set of playing cards 6 and the second pickup unit 20 is aimed at one respective card-recovery slot 7, enabling the first pickup unit 10 to pick up another playing card 6 and the second pickup unit 20 to exhibit the respective playing card 6. Thereafter, as shown in FIG. 10, the first pickup unit 10 is controlled to let the respective playing card 6 face toward the video recognition device 8 for recognition, and at the same time, the second pickup unit 20 is controlled to discard the respective playing card 6 onto the respective card-recovery slot 7. Thus, the first pickup unit 10 and the second pickup unit 20 are alternatively controlled to run playing card pickup step, playing card recognition step, playing card exhibition step and playing card discarding step.

As stated above, the first pickup unit 10 and the second pickup unit 20 are alternatively controlled to run playing card pickup step, playing card recognition step, playing card exhibition step and playing card discarding step. When the first pickup unit 10 runs the playing card pickup step, the second pickup unit 20 runs the playing card exhibition step; when the first pickup unit 10 runs the playing card recognition step, the second pickup unit 20 runs the playing card recovery step; when the first pickup unit 10 runs the playing card exhibition step, the second pickup unit 20 runs the playing card pickup step; when the first pickup unit 10 runs the playing card recovery step, the second pickup unit 20 runs the playing card recognition step. Thus, the card game machine can simulate the operation of a dealer to deal playing cards rapidly, avoiding cheating in playing the game.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A card game machine comprising:

a machine base, a track unit arranged on said machine base, a displacement motor mounted on said machine base, two card-recovery slots, a video recognition device adapted for recognizing the types and spots of each individual playing card of a set of playing cards being arranged on said machine base, a slide coupled to and movable along said track unit, a transmission belt coupled between said slide and said displacement motor for enabling said slide to be moved by said displacement motor along said track unit, and a first pickup unit and a second pickup unit carried on said slide, each of said first pickup unit and said second pickup unit being controllable to run a playing card pickup step, a playing card recognition step, a playing card exhibition step and a playing card discarding step, said first pickup unit and said second pickup unit each comprising a reversible step motor, a swivel arm coupled to said reversible step motor and movable by said reversible step motor within a predetermined angle, an air cylinder coupled to said swivel arm, a vacuum mount mounted on a reciprocating rod of said air cylinder and controllable to pick up one playing card from said set of playing cards by vacuum suction.

* * * * *